US009211558B1

(12) United States Patent
Pierson et al.

(10) Patent No.: US 9,211,558 B1
(45) Date of Patent: Dec. 15, 2015

(54) TOOTHPASTE DISPENSER

(76) Inventors: Mark V. Pierson, Binghamton, NY (US); Mark Levy, Aventura, FL (US)

( * ) Notice: Subject to any disclaimer, the term of this patent is extended or adjusted under 35 U.S.C. 154(b) by 169 days.

(21) Appl. No.: 13/609,721

(22) Filed: Sep. 11, 2012

(51) Int. Cl.
*B67D 7/58* (2010.01)
*B05B 11/00* (2006.01)

(52) U.S. Cl.
CPC ..... *B05B 11/3015* (2013.01); *B05B 11/007* (2013.01); *B05B 11/304* (2013.01); *B05B 11/3074* (2013.01)

(58) Field of Classification Search
CPC ..... B05D 11/00; B05D 11/3015; B05D 11/3074; B05D 11/304; B05D 11/0032; B05D 11/0043; B05D 11/0048; B05D 11/007; B05D 11/3001; B05D 11/3004
USPC ..... 222/380, 383.1, 325–327, 494, 95–96, 222/394, 207, 181.1
See application file for complete search history.

(56) References Cited

U.S. PATENT DOCUMENTS

| | | | | |
|---|---|---|---|---|
| 2,789,731 | A | 4/1957 | Marraffino | |
| 4,258,864 | A | 3/1981 | Karamanolis et al. | |
| 4,461,403 | A | 7/1984 | Prahs | |
| 4,515,294 | A * | 5/1985 | Udall | 222/105 |
| 4,859,404 | A * | 8/1989 | Richard | 376/293 |
| 4,955,567 | A | 9/1990 | Longhurst | |
| 5,020,694 | A | 6/1991 | Pettengill | |
| 5,579,959 | A * | 12/1996 | Bennett et al. | 222/385 |
| 5,779,147 | A * | 7/1998 | Rosse | 239/99 |
| 6,019,256 | A * | 2/2000 | Seltzer | 222/385 |
| 6,450,373 | B1 * | 9/2002 | Seltzer | 222/385 |
| 7,086,568 | B1 | 8/2006 | Cheek | |
| 7,651,012 | B2 * | 1/2010 | Colman et al. | 222/372 |
| 8,152,029 | B2 * | 4/2012 | Tuyls et al. | 222/318 |
| 8,393,499 | B1 * | 3/2013 | Sholem | 222/135 |
| 2003/0075561 | A1 | 4/2003 | Pieri | |

* cited by examiner

*Primary Examiner* — Frederick C Nicolas
(74) *Attorney, Agent, or Firm* — Mark Levy; Hinman, Howard & Kattell, LLP

(57) ABSTRACT

A toothpaste dispenser having an upper chamber and an inlet port connected for receiving toothpaste and a lower chamber and an outlet port connected for dispensing toothpaste. Suction is created to draw toothpaste into the inlet port, and then forced through the outlet port during actuation. Initiating operation of the suction pulls toothpaste into an upper chamber, and a plunger for expelling the toothpaste from the chamber is operatively connected to the outflow ball check valve for intermittently blocking the flow of toothpaste into and from the toothpaste dispenser. The toothpaste dispenser utilizes ball check valves and two return springs operatively connected to the ball check valves. The toothpaste dispenser actuation has a plunger and also has a portion size adjustment device connected to the plunger for modifying the amount of toothpaste dispensed from the toothpaste dispenser.

13 Claims, 13 Drawing Sheets

Perspective View

Side

Front

Perspective View

Side

Front

TOOTHPASTE DISPENSER

FIELD OF THE INVENTION

The present invention pertains to toothpaste dispensers and, more particularly, to a one-hand-operated dispenser directly connected to a tube of toothpaste with a mechanism for metering toothpaste to be used.

BACKGROUND OF THE INVENTION

Oral health care and tooth cleaning dates back before 2000 B.C. in the Middle East, when abrasives such as crushed bone, crushed egg, and oyster shells were used to clean debris from teeth. In the early 18th century, Pierre Fauchard, a French surgeon, published a book entitled, "The Surgeon Dentist, A Treatise on Teeth," that included information some have called the foundation of modern dentistry.

Prior to the 1850s, toothpastes were actually powders. During the 1850s, a toothpaste-in-a-jar called Crème Dentifrice was developed. Betel nut was included in toothpaste in England in the 1800s, and in the 1860s a home encyclopedia described homemade toothpaste that used ground charcoal.

Tooth powder, available from the late 18$^{th}$ century until the latter part of the 19$^{th}$ century, comprised charcoal and powdered bark and was packaged in a ceramic container as a powder or paste. Brushes, twigs, fabric, or the user's finger could apply such powder. A dentist then added soap to toothpaste in 1824. Chalk was subsequently added to the mixture. In 1873, the Colgate Company started mass-producing toothpaste with more pleasing flavor in jars. Colgate introduced toothpaste in a tube similar to modern-day toothpaste tubes in the 1890s. Such pre-mixed toothpastes were first marketed in the 19th century, but did not surpass the popularity of tooth powder until World War I.

Until 1945, toothpastes contained soap. After that time, other ingredients such as sodium lauryl sulphate made the paste into a smooth emulsion and replaced soap. By 1900, a paste made of hydrogen peroxide and baking soda was recommended.

In the second half of the twentieth century modern toothpastes were developed to help prevent or treat specific diseases and conditions such as tooth sensitivity. Toothpastes with very low abrasiveness were also developed and helped prevent problems caused by overzealous brushing.

The breakthrough that transformed toothpaste into the crucial weapon against tooth decay was the finding that fluoride could dramatically reduce cavities. Fluoride was added to toothpaste in the early 1960s, and soluble calcium fluoride was added some 20 years later. A 1962 study at Newburgh, N.Y., one of the first cities to add fluoride to its water supply, found that in 15 years, cavities dropped by 70 percent.

For over 50 years, adding fluoride to drinking water has been seen as a magic bullet to conquer tooth decay. In fact, in 1999, the Centers for Disease Control (CDC) named the fluoridation of drinking supplies as one of the 20$^{th}$ century's top ten advancements in public health.

But some scientists have questioned fluoride's safety and believe Americans could be ingesting toxic levels. Despite fluoride's obvious benefits as a cavity fighter, it is, nevertheless, a poison. In fact, before its efficacy as a tooth decay inhibitor was discovered, it was used mainly as a rat and insect poison.

A recent review in "The Lancet" describes fluoride as "an emerging neurotoxin substance" that may damage the developing brain. The National Research Council (NRC) has identified fluoride as an "endocrine disrupter" that may impair thyroid function. A recent Harvard University study links fluoride to bone cancer. Several Chinese studies found links between high fluoride levels and lower intelligence. Russell Blaylock, a neurosurgeon, warns that fluoride may be linked to neurological impairment, brain diseases like Alzheimer's, male impotence and infertility, sleep impairment, retardation in children, and numerous cancers.

The CDC estimates the average American gets between 1 mg/L and 3 mg/L of fluoride daily and has set a goal of 1 mg/L. However, even that low level may increase health risks. One study showed that elderly men who drank water with only 1 mg/L fluoride had a 41 percent increase in the risk of hip fractures.

Americans, it is estimated, brush their teeth nearly 200 billion times a year and spend more than $1.6 billion on products relating to such activity. Toothpastes today typically contain fluoride, coloring, flavoring, and sweetener, as well as ingredients that render the toothpaste a smooth paste. When used, the paste foams and stays moist.

Modern toothpaste, which contains abrasives that physically scrub away plaque, works with a toothbrush to clean teeth and impedes the growth of plaque bacteria. Most of the cleaning is achieved by the mechanical action of the toothbrush, not by the toothpaste. The chemicals that hinder the growth of plaque bacteria include ingredients such as natural xylitol and artificial triclosan. In addition to removing food stains from teeth, toothpaste abrasives polish tooth surfaces.

Toothpaste in tubes is used throughout the world. Prior to WWII, toothpaste was packaged in small lead/tin alloy tubes. In the late 19$^{th}$ century, Washington Sheffield of Connecticut inserted toothpaste into a collapsible lead tube. The inside of the tube was coated with wax, but lead from the tubes leached into the product. It was the shortage of lead and tin during WWII that led to the use of laminated (aluminum, paper, and plastic combination) tubes. At the end of the 20$^{th}$ century pure plastic tubes were used.

Striped toothpaste was invented by Leonard Marraffino, described in U.S. Pat. No. 2,789,731 and issued 1957. The main material or carrier, usually white, is disposed at the crimp end of the toothpaste tube and constitutes the greatest volume. A thin pipe, through which the main carrier material flows, descends from the nozzle thereto. The colored stripe material fills the gap between the carrier material and the top of the tube.

The two materials are not in separate compartments, but are sufficiently viscous that they will not mix. When pressure is applied to the toothpaste tube, the main material squeezes down the thin pipe to the nozzle. Simultaneously, the pressure applied to the main material is translated to the stripe material, which then issues through small holes in the side of the pipe onto the main carrier material as it passes those holes.

Layered toothpaste, not to be confused with striped toothpaste, requires a multi-chamber design (e.g., U.S. Pat. No. 5,020,694), in which two or three layers extrude out of the nozzle. This scheme, like that of pump dispensers (e.g., U.S. Pat. No. 4,461,403), is more complicated and thus more expensive to manufacture than either the Marraffino or the Colgate composition.

The basic fundamentals of toothbrushes have not changed since the times of the Egyptians and Babylonians. A handle is used to grip, and a bristle-like feature cleans the teeth. The Chinese are believed to have invented the first natural bristle toothbrush made from bristles of pigs' necks in the 15$^{th}$ century, the bristles being attached to a bone or bamboo handle. When it was brought from China to Europe, this design was adapted and often used softer horsehairs which many Europeans preferred. Other designs in Europe used feathers.

One of the first toothbrushes of a more modern design was made by William Addis in England around 1780. The handle was carved from cattle bone and the brush portion was still made from swine bristles. In 1844, the first 3-row bristle brush was designed.

Toothbrush bristles are now usually synthetic and range from very soft to soft in texture, although harder bristle versions are available. Toothbrush heads range from very small for young children to larger sizes for adults. Over its long history, the toothbrush has evolved to become a scientifically designed tool using modern ergonomic designs and hygienic materials.

DISCUSSION OF THE RELATED ART

U.S. Pat. No. 7,086,568 by Cheek for TOOTHPASTE DISPENSER discloses a household apparatus for dispensing toothpaste from a tube of toothpaste. A toothpaste dispenser is removably mounted to a wall surface. The tube of toothpaste is mounted within the dispenser. Pushing inwardly on a plunger connected to the toothpaste dispenser dispenses a small volume of toothpaste.

U.S. Pat. No. 4,258,864 by Karamanolis, et al. for TOOTHPASTE DISPENSER discloses an automatic toothpaste dispenser that employs a roller-type squeeze device driven along the toothpaste tube simultaneously with the opening of a gate that permits the toothpaste to flow. After the desired amount of toothpaste has been dispensed, the roller is automatically retracted and the gate is simultaneously closed.

U.S. Pat. No. 7,651,012 by Coleman, et al. for TOOTHPASTE DISPENSER, TOOTHPASTE DISPENSING SYSTEM AND KIT discloses a toothpaste dispensing system that includes a pumping system disposed in a housing. The pumping system has an inlet and an outlet, and a rest state and an active state. A low-force activator is coupled to the pumping system to transition the pumping system from the rest state to active state, ejecting the toothpaste.

United States Published Patent Application No. 2003/0075561 by Pieri for TOOTHPASTE DISPENSER discloses a toothpaste dispenser capable of dispensing individual quantity controlled amounts of toothpaste. The dispenser includes an elongated strip having a plurality of one time use sachets formed integrally therewith, each sachet containing a measured quantity of toothpaste suitable for a single use. The strip is provided with weakened portions so that individually numbered sachets may detached from the strip. The individual sachets may be opened after they are detached from the strip and the contents may be squeezed out.

U.S. Pat. No. 4,955,567 by Longhurst for TOOTHBRUSH HOLDER FOR UPRIGHT TOOTHPASTE DISPENSER discloses a toothpaste dispenser grasping member that fits over conventional, commercially available upright toothpaste dispensers. A toothbrush holding tray is rigidly connected to the top of the toothpaste dispenser grasping member so that the bristles of a toothbrush placed on the toothbrush holding tray are located below the nozzle of the toothpaste dispenser. To ensure that the bristles are located properly under the nozzle, an alternative embodiment includes a toothbrush stop positioned on the toothbrush holding tray.

It is a primary object of the invention to enhance the art of controlled toothpaste dispensing.

It is another object of the invention to allow clean, controlled one-handed-dispensing of toothpaste.

According to another object of the invention, there is provided a one-handed operation of the toothpaste dispensing act from start to finish.

SUMMARY OF THE INVENTION

The present invention is a toothpaste dispenser having an upper chamber and an inlet port connected for receiving toothpaste and a lower chamber and an outlet port connected for dispensing toothpaste. Suction is created to draw toothpaste into the inlet port, and then forced through the outlet port during actuation. Initiating operation of the suction pulls toothpaste into an upper chamber, and means for expelling the toothpaste from the chamber is operatively connected to the actuation means for intermittently blocking the flow of toothpaste into and from the toothpaste dispenser. The toothpaste dispenser utilizes ball check valves and two return springs operatively connected to the ball check valves. The toothpaste dispenser actuation has a plunger and also has a portion size adjustment device connected to the plunger for modifying the amount of toothpaste dispensed from the toothpaste dispenser.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The invention is a toothpaste dispenser having an upper chamber and an inlet port for receiving toothpaste and a lower chamber and an outlet port for dispensing toothpaste. The dispenser operates solely on mechanical principles, specifically with the use of appropriate valves to control suction and dispensing force. Toothpaste is manually squeezed through the upper, lower chamber and out the exit nozzle to prime the unit for use. Suction is created to draw toothpaste into the inlet port, and then the paste is forced through the outlet port during actuation. Means for expelling the toothpaste from the chamber is operatively connected to the actuation means for intermittently blocking the flow of toothpaste into and from the toothpaste dispenser. The toothpaste dispenser utilizes ball check valves and return springs operatively connected thereto. The toothpaste dispenser actuation means has a plunger and also has a portion size adjustment device connected thereto for modifying the amount of toothpaste dispensed from the dispenser.

Figure 1:
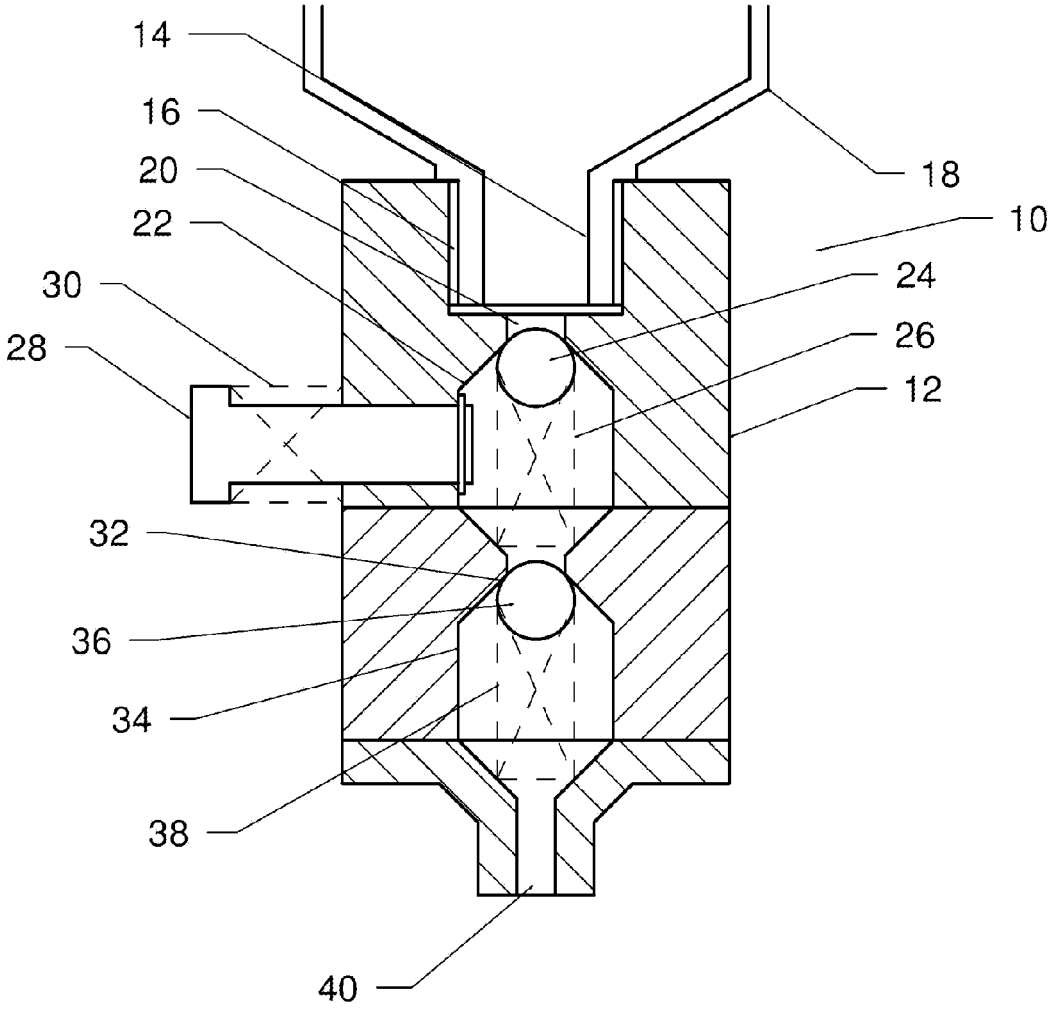
FIG. 1 is a cross-sectional schematic view of the toothpaste dispenser in accordance with the present invention.

Referring now to FIG. 1, there is shown a cross-sectional schematic view of the inventive toothpaste dispenser shown generally at reference numeral 10. A housing or body 12 is generally hollow and is equipped with an inflow port 14 having interior threads 16 formed therein. Such threads 16 are adapted to mate with a conventional tube of toothpaste 18.

A hollow channel 20 connects inflow port 14 to a hollow upper chamber 22 having an inflow ball check valve 24 at the uppermost portion thereof. Connected to inflow ball check valve 24 is a return inflow compression spring.

An actuation, spring-loaded plunger 28 extends from body 12 to the exterior of upper chamber 22 to apply pressure thereto. Plunger 28 has a compression spring 30 associated therewith.

A hollow lower chamber 34 is disposed beneath upper chamber 22, as shown. At the uppermost portion of lower chamber 34 is a valve seat 32 into which an outflow ball check valve 36 rests. An outflow compression spring 38 is operatively connected to outflow ball check valve 36.

Oppositely disposed to inflow port 14 is an outflow or dispensing port 40 in communication with lower chamber 34.

Figure 2:
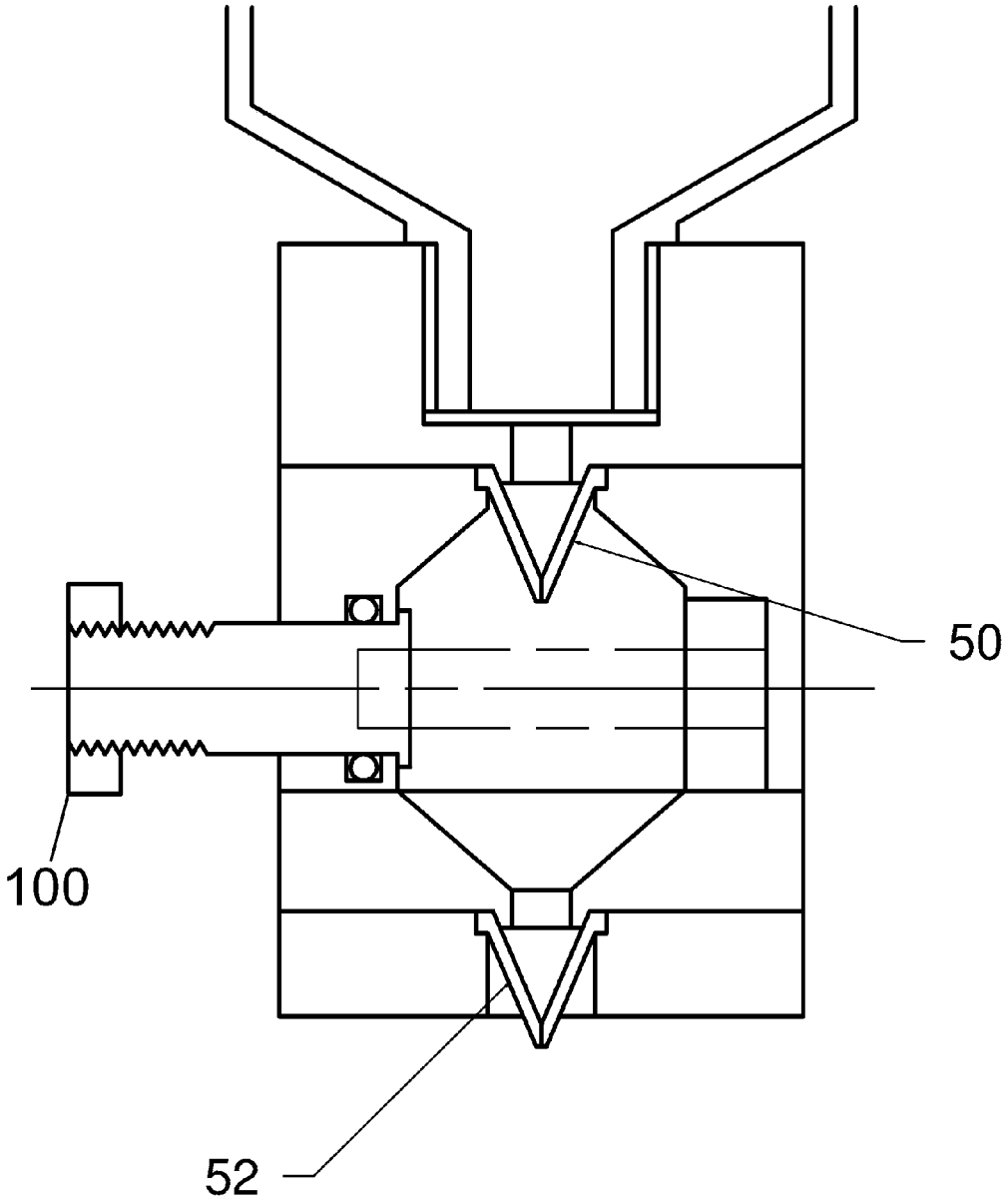
FIG. 2 is a cross-sectional schematic view of an alternate embodiment of the invention.

Referring now to FIG. 2, an alternate embodiment of the toothpaste dispenser is shown, in which inflow and outflow duckbill check valves 50 and 52 replace the inflow and outflow ball check valves 24 and 36 (FIG. 1), respectively. A stop nut 100 can be turned to adjust the volume of toothpaste in the chamber between inflow and outflow duckbill check valves 50 and 52.

Figure 3:
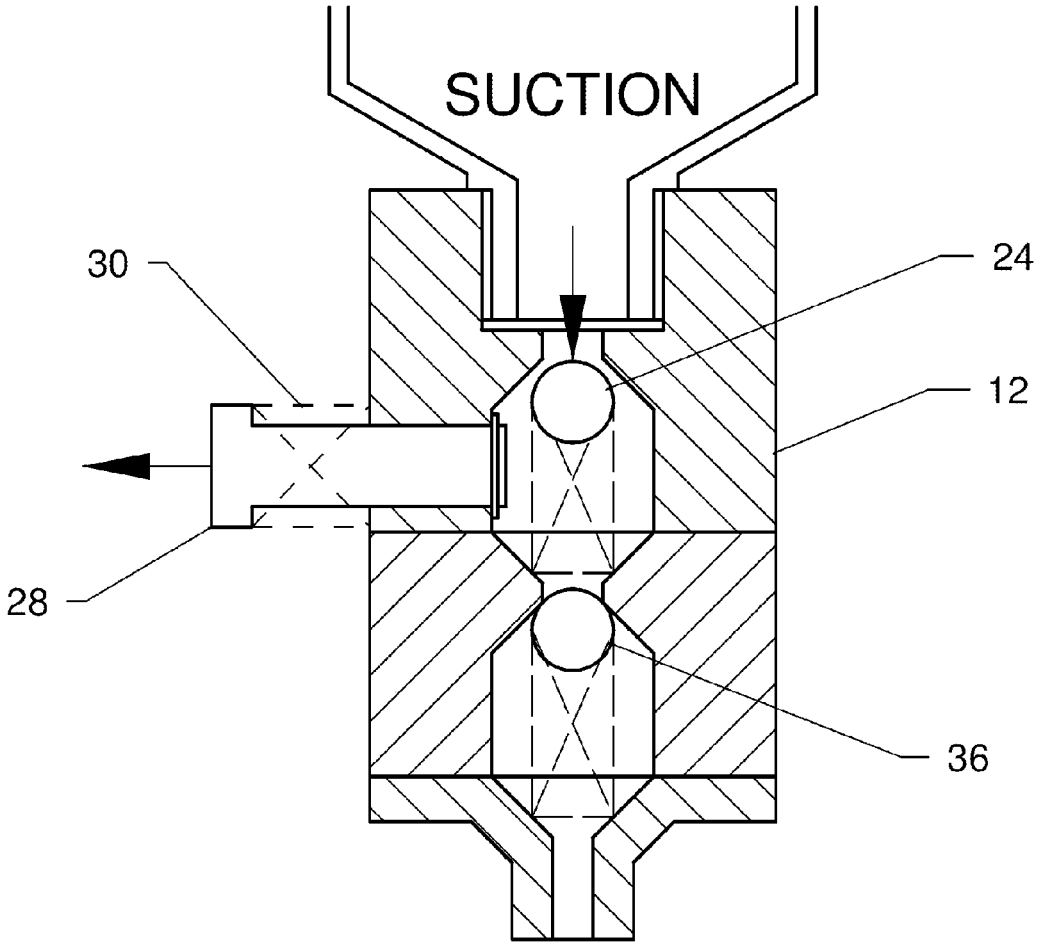
FIG. 3 is a cross-sectional schematic view of the toothpaste dispenser of FIG. 1 in the intake cycle.
Figure 4:
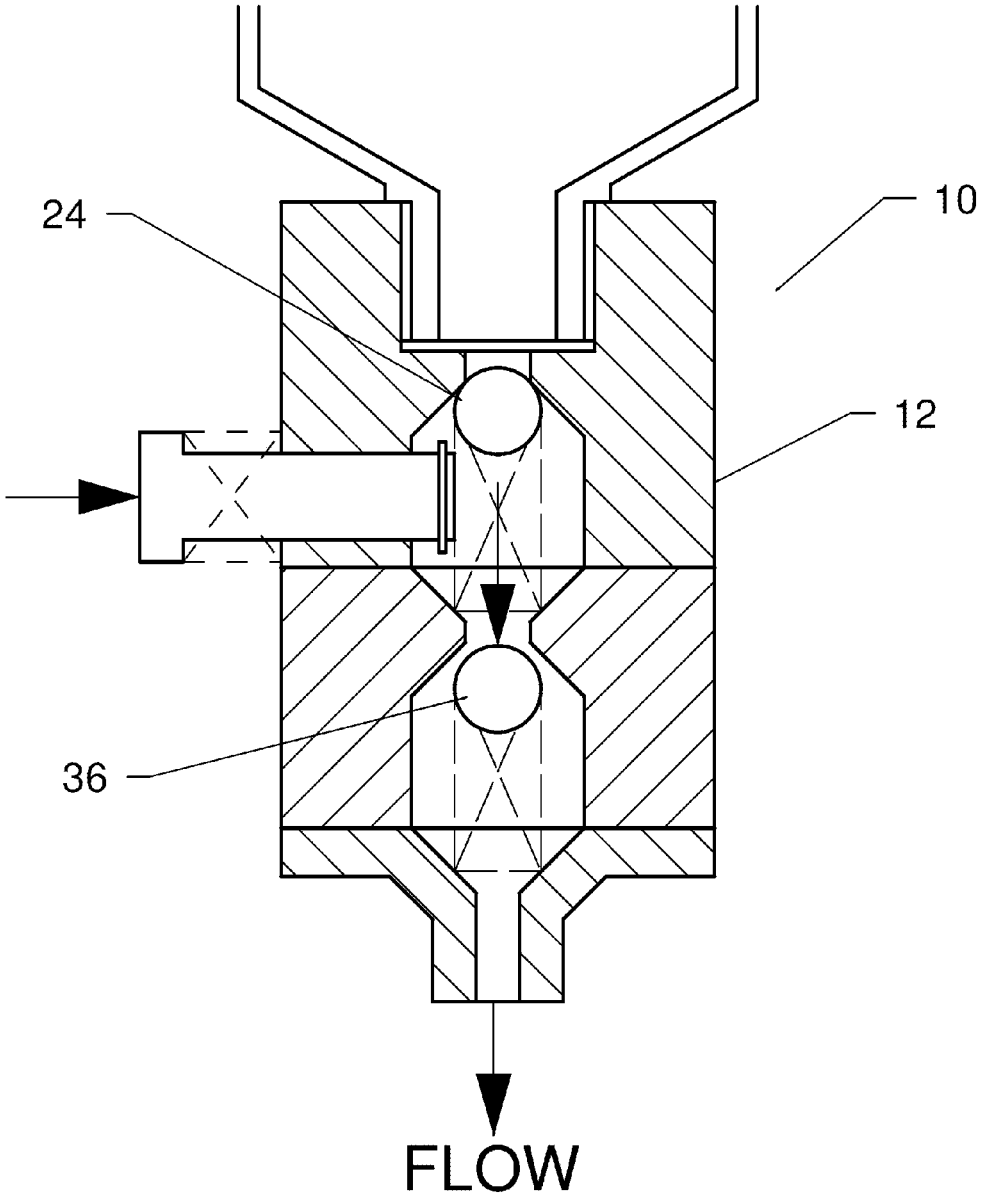
FIG. 4 is a cross-sectional schematic view of the toothpaste dispenser of FIG. 1 in the dispense cycle.
Figure 5A:
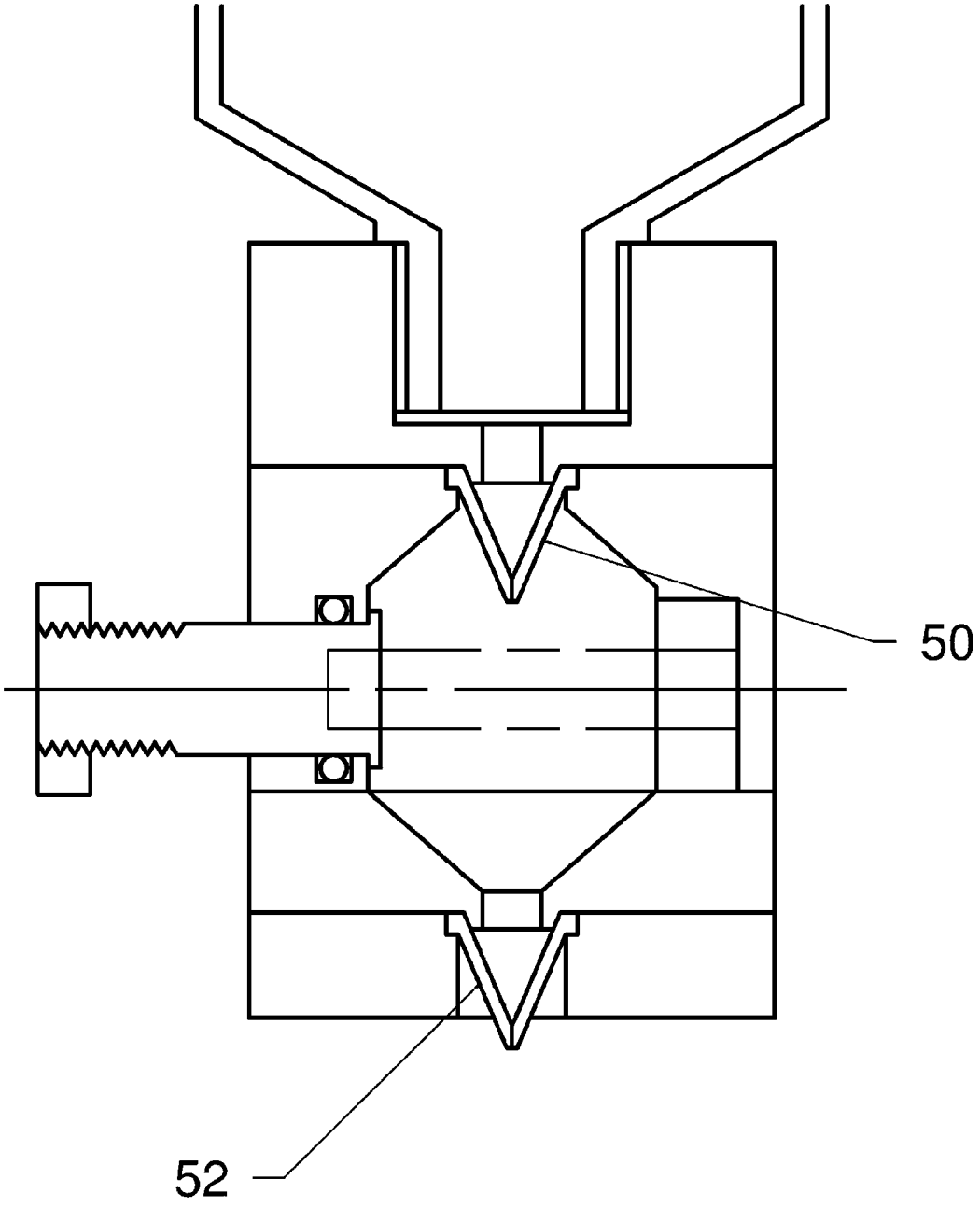
FIGS. 5*a* through 5*e* are perspective views of various products that incorporate the toothpaste dispenser of the invention.
Figure 5B:
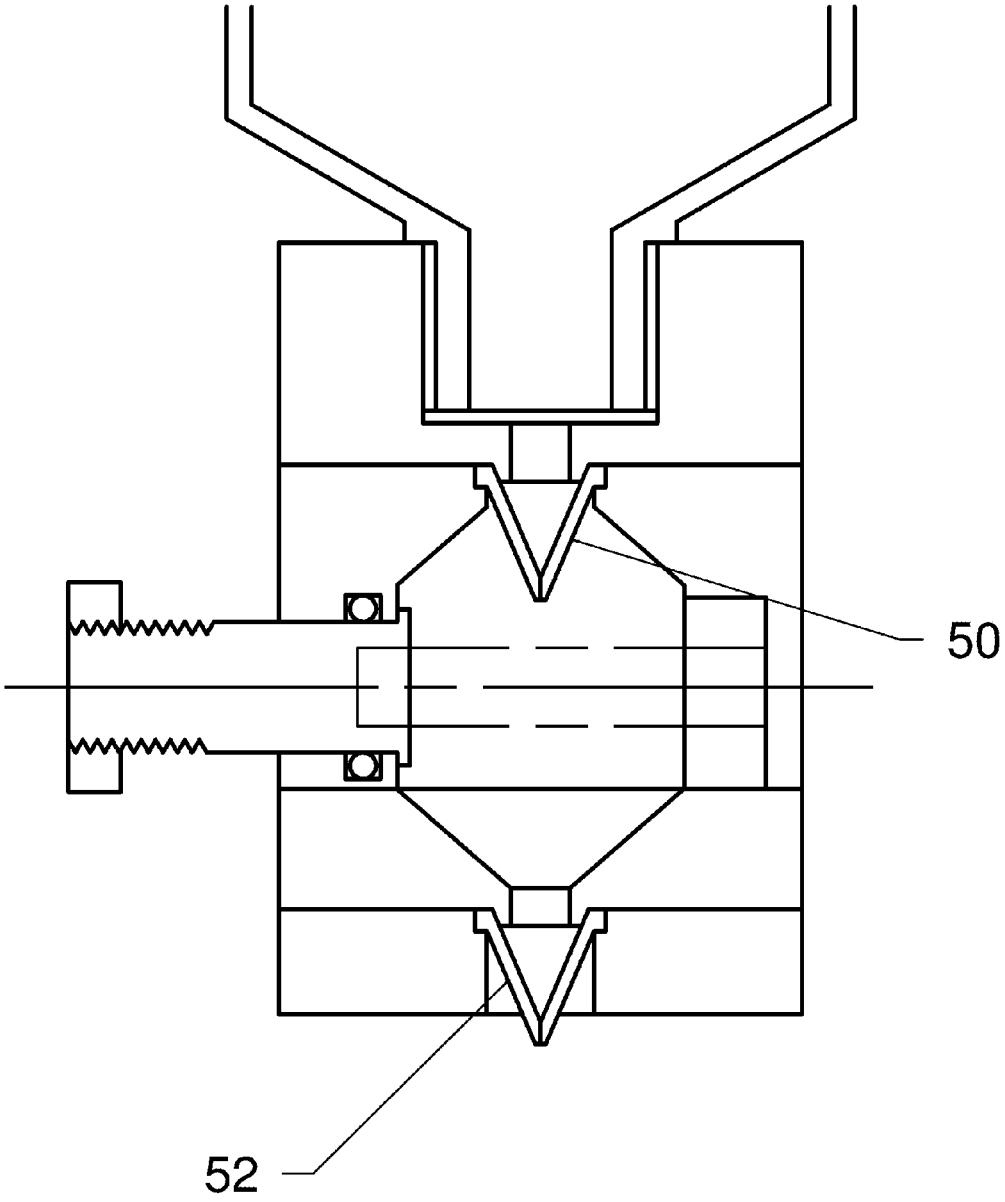
Figure 5C:
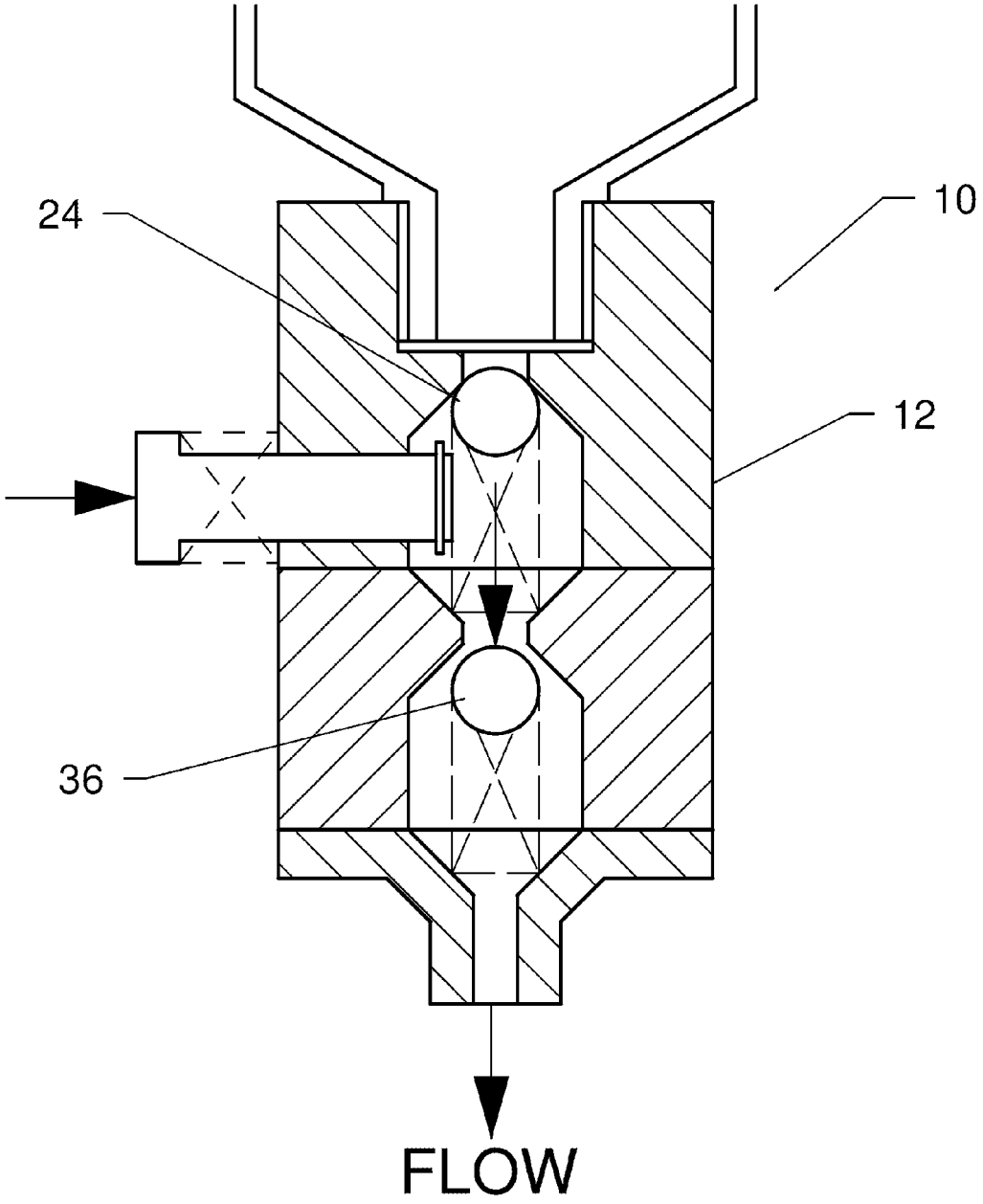
Figure 5D:
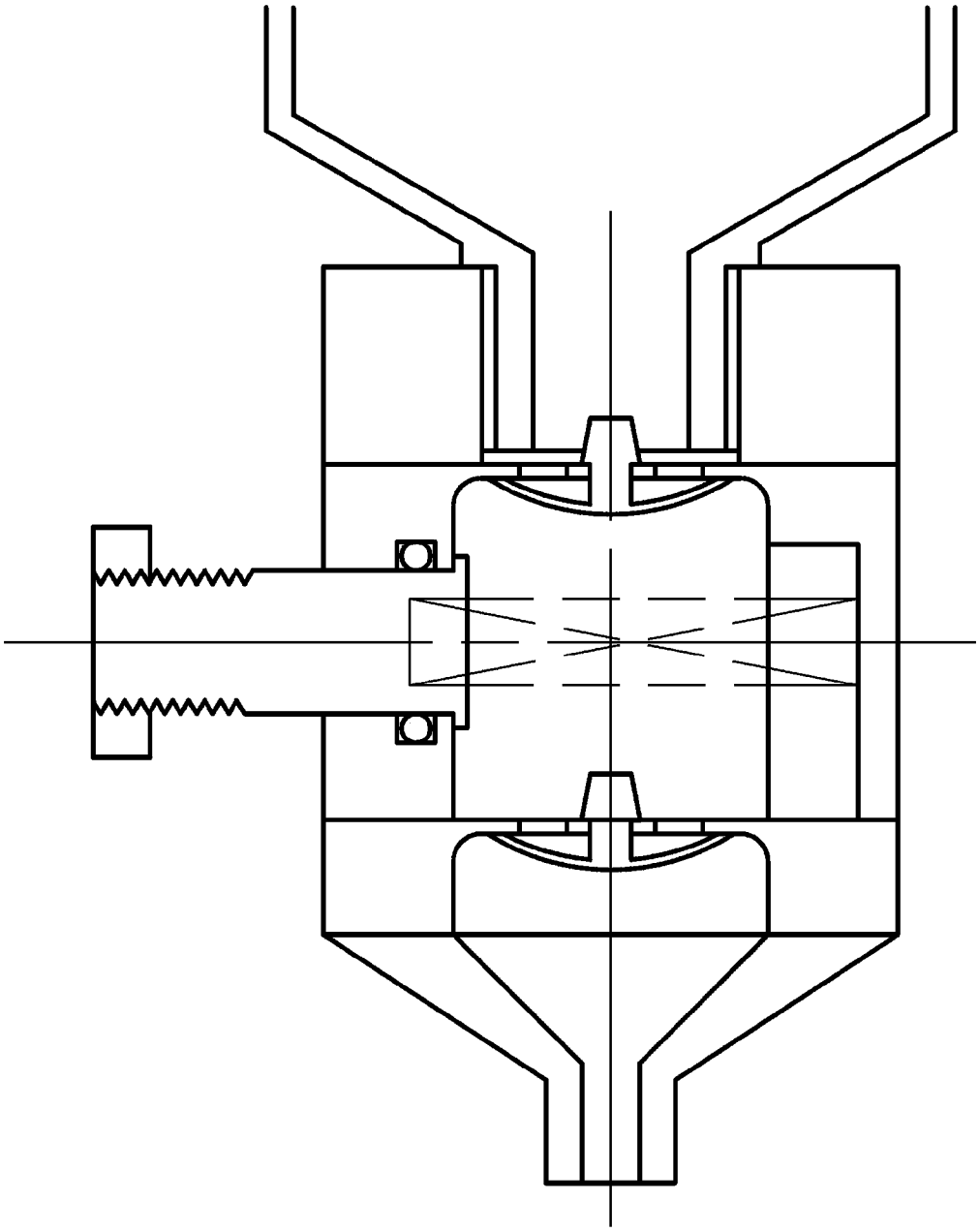
Figure 5E:
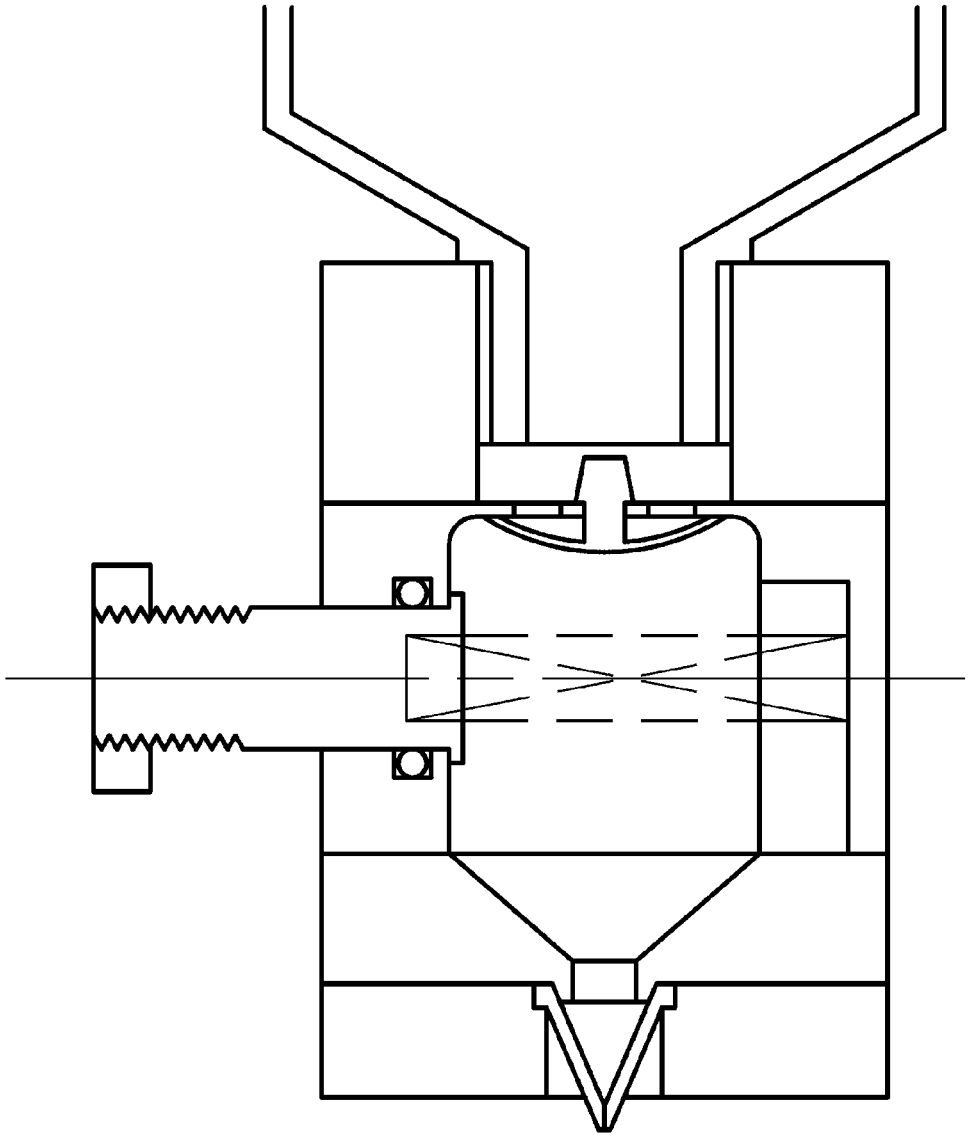

Referring now also to FIG. 3, there are shown positions of check valves 24 and 36 during the first cycle of dispenser operation. Similarly, FIG. 4 depicts positions of check valves 24 and 36 during the second or dispensing cycle of operation. In operation, plunger 28 is used to actuate toothpaste dispenser 10. When plunger 28 is pulled outwardly from upper chamber 22, suction is created, moving inflow ball check valve 24 downwardly in upper chamber 22 and drawing toothpaste, not shown, downwardly from toothpaste tube 18 to flow around valve 24 and at least partially fill upper chamber 22. Inflow spring 26 aids in repositioning inflow ball check valve 24 to its quiescent position at the upper portion of upper chamber 22.

Upon pressing plunger 28 to the right, initiating the second or dispensing cycle of operation, inflow ball check valve 24 moves upwardly, blocking the backwash of toothpaste to toothpaste tube 18 and outflow ball check valve 36 is forced to move downwardly in lower chamber 34, so that toothpaste flows downwardly around valve 36 and into lower chamber 34. Toothpaste is then expelled from lower chamber 34 through outflow port 40 and dispensed onto a toothbrush, not shown, proximate port 40. Outflow spring 38 aids in repositioning outflow ball check valve 36 to its quiescent position at the upper portion of lower chamber 34 when flow ceases.

It should be understood that toothpaste dispenser 10 may be incorporated into other shapes, some of which are depicted in FIGS. 5*a* through 5*d*. Moreover, plunger 30 may take the form of other embodiments than those shown in the FIGURES. For example, electrically, pneumatically or hydraulically actuated switches are all considered within the scope of the present invention.

Figure 6C:
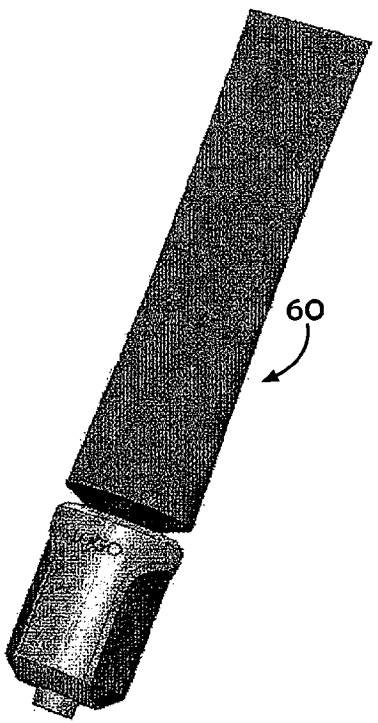
FIGS. 6*a* through 6*c* are schematic views of a dispenser incorporating the mechanism shown in FIG. 1.
Figure 6B:
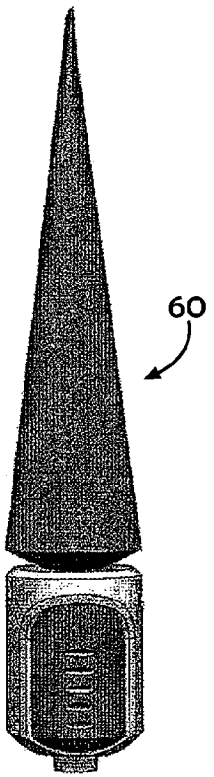
Figure 6A:
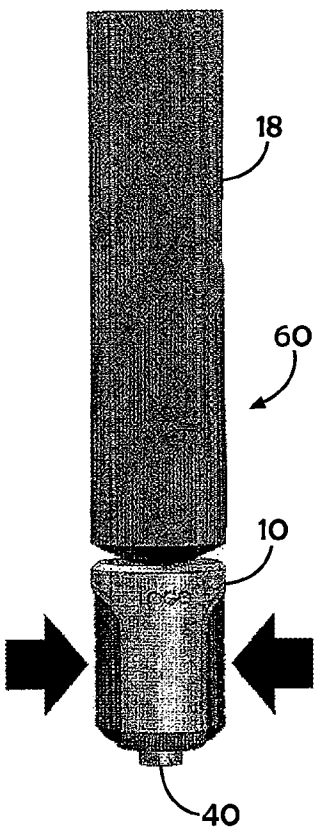

FIGS. 6*a* through 6*c* are schematic views of a dispenser 60 for adults incorporating the mechanism 10 shown in FIG. 1. A front view of dispenser 60 with tube of toothpaste 18 is shown in FIG. 6*a*; a side view is shown in FIG. 6*b*; and a perspective view is shown in FIG. 6*c*.

Figure 7C:
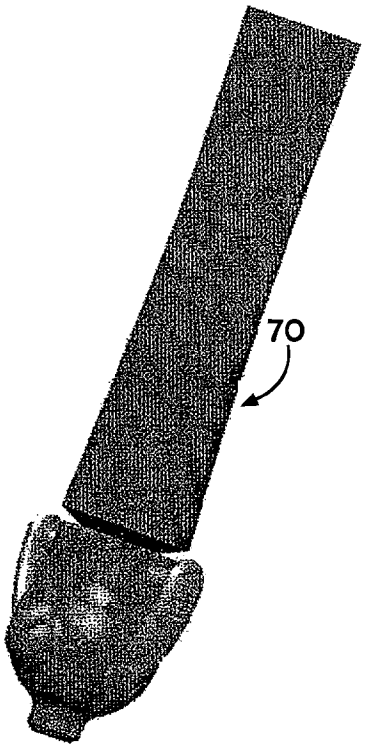
FIGS. 7*a* through 7*c* are schematic views of an alternate embodiment of a dispenser incorporating the mechanism shown in FIG. 1.
Figure 7B:
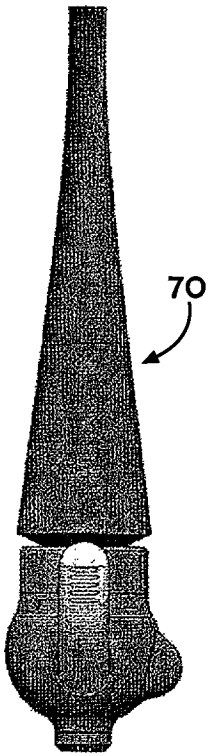
Figure 7A:
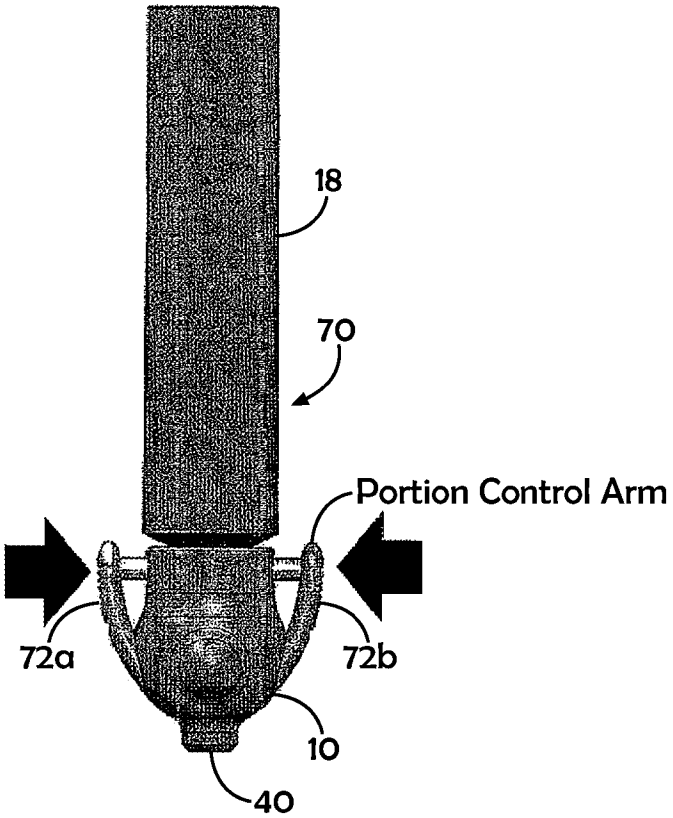

FIGS. 7*a* through 7*c* are schematic views of an alternate embodiment of a dispenser 70 for children incorporating the mechanism 10 shown in FIG. 1. A cartoon character is formed at the dispensing end of dispenser 70. A front view of dispenser 70 is shown in FIG. 7*a*; a side view is shown in FIG. 7*b*; and a perspective view is shown in FIG. 7*c*. Oppositely disposed, spring-loaded arms 72*a*, 72*b* are provided at the upper portion of mechanism 10 and described in greater detail hereinbelow.

Figure 8A:
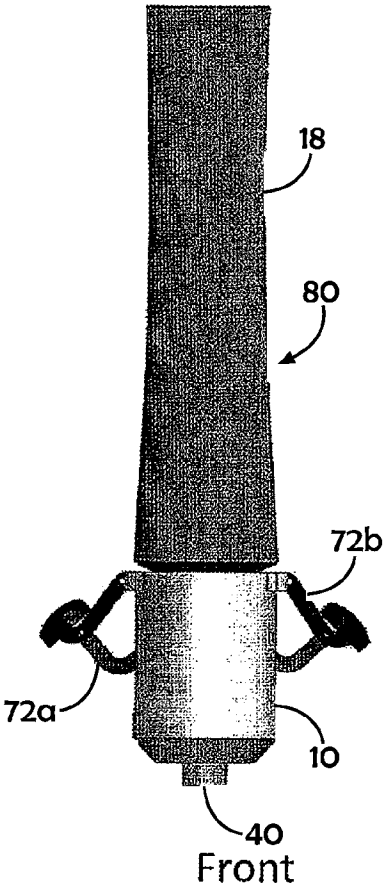
FIGS. 8*a* through 8*c* are schematic views of another embodiment of a dispenser incorporating the mechanism shown in FIG. 1.
Figure 8B:
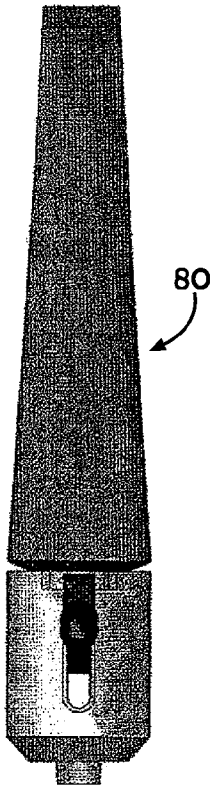
Figure 8C:
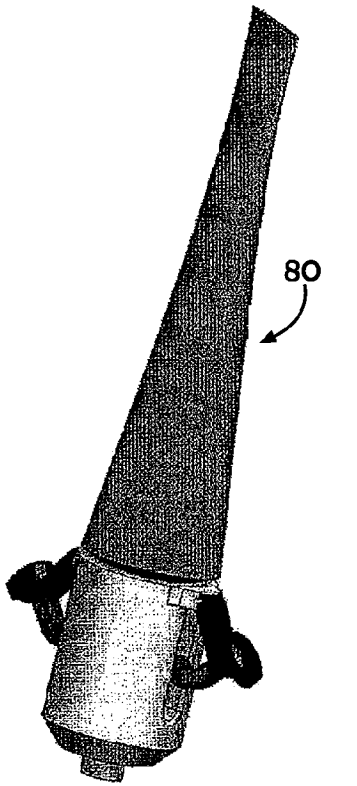

FIGS. 8*a* through 8*c* are schematic views of another embodiment of a dispenser 80 for aged or handicapped individuals incorporating the mechanism 10 shown in FIG. 1. A front view of dispenser 80 is shown in FIG. 8*a*; a side view is shown in FIG. 8*b*; and a perspective view is shown in FIG. 8*c*.

Figure 9C:
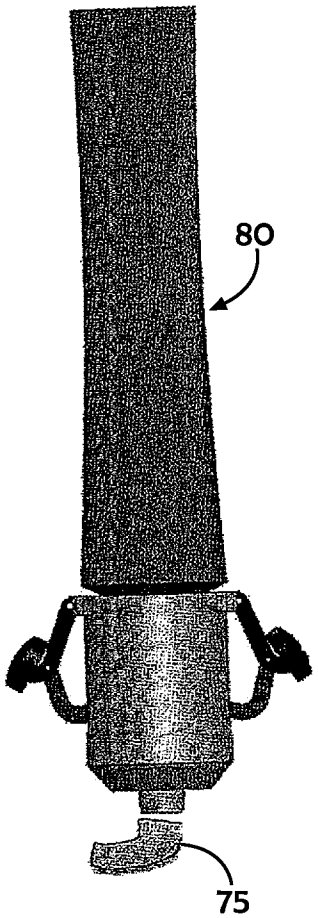
FIGS. 9*a* through 9*c* are schematic views of the dispenser shown in FIGS. 8*a* through 8*c* at three stages of operation.
Figure 9B:
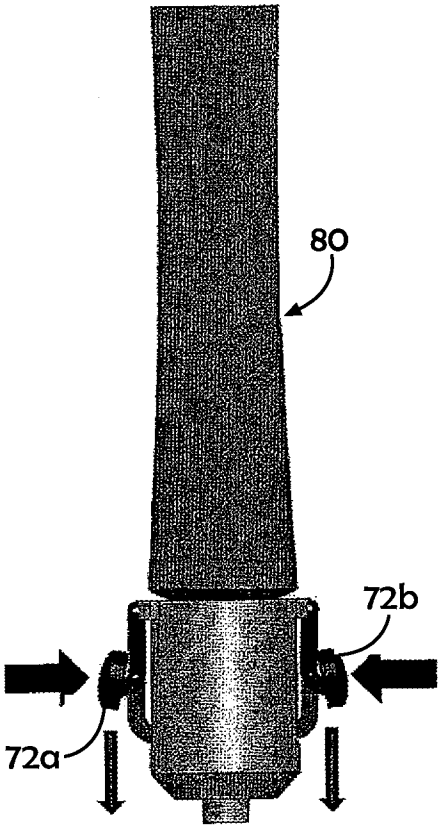
Figure 9A:
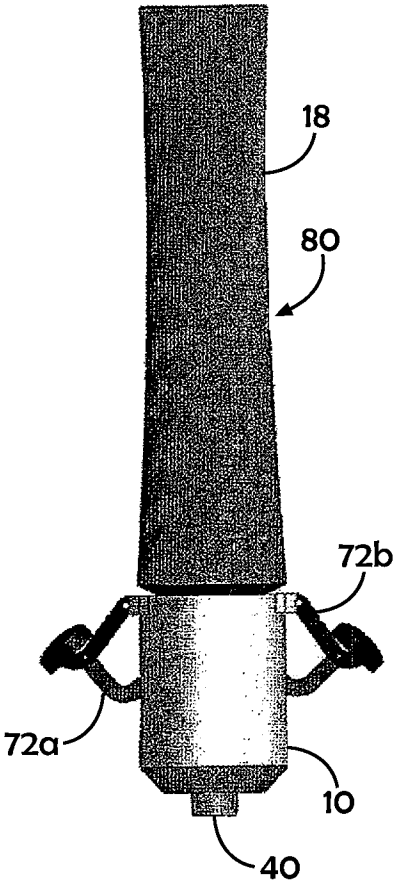

FIGS. 9*a* through 9*c* are schematic views of the dispenser shown in FIGS. 8*a*-8*c* at three stages of operation. FIG. 9*a* shows dispenser 80 in its quiescent state; FIG. 9*b* shows dispenser when side arms 72*a*, 72*b* and respective, associated buttons 74*a*, 74*b* are depressed, so that plunger 28 and compression spring 30 (FIG. 3) are compressed; and FIG. 9*c* shows dispenser after side buttons 72*a*, 72*b* are released and toothpaste 75 is expelled from outflow port 40.

It should be understood that other designs for dispenser can be conceived besides those shown above without departing from the scope of the invention.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A toothpaste dispenser comprising:

a) a housing having an upper chamber and an inlet port connected thereto for receiving toothpaste and a lower chamber and an outlet port connected thereto for dispensing toothpaste;

b) means for creating suction to draw toothpaste into said inlet port;

c) means for forcing toothpaste through said outlet port;

d) a plunger for initiating operation of said suction creating means and said toothpaste forcing means;

e) means operatively connected to said plunger for intermittently blocking the flow of toothpaste into said toothpaste dispenser and from said toothpaste dispenser; and f) portion adjustment means connected to said plunger for specifying the quantity of toothpaste dispensed from said toothpaste dispenser.

2. The toothpaste dispenser in accordance with claim 1, wherein said input port comprises internal threads for mating with a toothpaste tube.

3. The toothpaste dispenser in accordance with claim 1, wherein said means for intermittently blocking comprises two valves.

4. The toothpaste dispenser in accordance with claim 3, wherein said two valves comprise ball check valves.

5. The toothpaste dispenser in accordance with claim 4, further comprising:

g) two return springs operatively connected to said ball check valves.

6. The toothpaste dispenser in accordance with claim 3, wherein said two valves comprise duckbill check valves.

7. The toothpaste dispenser in accordance with claim 1, wherein said means for intermittently blocking simultaneously and alternately blocks and unblocks said respective inlet and outlet.

8. The toothpaste dispenser in accordance with claim 1, wherein said plunger is spring loaded.

9. A dispenser for toothpaste comprising:

a) a substantially hollow body;

b) an upper chamber disposed in said body and having an inlet port connected thereto;

c) a lower chamber disposed in said body operatively connected to said upper chamber and having an outlet port connected thereto;

d) a spring-loaded plunger operatively connected to said upper chamber for creating a partial vacuum therein; and e) portion adjustment means connected to said plunger for specifying the quantity of toothpaste dispensed from said toothpaste dispenser.

10. The toothpaste dispenser in accordance with claim 9, further comprising:

f) an inlet valve operatively connected to said upper chamber; and g) an outlet valve operatively connected to said lower chamber.

11. The toothpaste dispenser in accordance with claim 10, wherein said two valves comprise ball check valves.

12. The toothpaste dispenser in accordance with claim 11, further comprising:

h) two return springs operatively connected to said ball check valves.

13. The toothpaste dispenser in accordance with claim 10, wherein said two valves comprise duckbill check valves.

* * * * *